US005594461A

United States Patent [19]

O'Neill, Jr.

[11] Patent Number: 5,594,461

[45] Date of Patent: Jan. 14, 1997

[54] LOW LOSS QUADRATURE MATCHING NETWORK FOR QUADRIFILAR HELIX ANTENNA

[75] Inventor: Gregory A. O'Neill, Jr., Cedar Rapids, Iowa

[73] Assignee: Rockwell International Corp., Seal Beach, Calif.

[21] Appl. No.: 450,737

[22] Filed: May 25, 1995

Related U.S. Application Data

[63] Continuation of Ser. No. 126,836, Sep. 24, 1993, abandoned.

[51] Int. Cl.[6] ..... H01Q 1/36

[52] U.S. Cl. ..... 343/895

[58] Field of Search ..... 343/895, 702; H01Q 1/36

[56] References Cited

U.S. PATENT DOCUMENTS

| | | | |
|---|---|---|---|
| 3,599,220 | 8/1971 | Dempsey | 343/895 X |
| 3,921,177 | 11/1975 | Munson | 343/846 |
| 4,356,462 | 10/1982 | Bowman | 333/128 |
| 4,595,891 | 6/1986 | Cronauer | 333/127 |
| 4,758,843 | 7/1988 | Agrawal et al. | 343/814 |
| 4,792,810 | 12/1988 | Fukuzawa et al. | 343/778 |
| 4,866,451 | 9/1989 | Chen | 343/700 |
| 4,914,445 | 4/1990 | Shoemaker | 343/700 |
| 4,963,892 | 10/1990 | Matsuo et al. | 343/700 |
| 5,126,704 | 6/1992 | Dittmer et al. | 333/125 |
| 5,170,176 | 12/1992 | Yasunaga et al. | 343/895 |
| 5,191,352 | 3/1993 | Branson | 343/850 |
| 5,198,831 | 3/1993 | Burrell et al. | 343/895 |

*Primary Examiner*—Donald T. Hajec
*Assistant Examiner*—Tho Phan
*Attorney, Agent, or Firm*—Gregory G. Williams; M. Lee Murrah; G. A. Montanye

[57] ABSTRACT

A quadrifilar antenna has first, second, third and fourth quadrature antenna elements with signals in a respective quadrature phase relationship. The antenna elements are coupled through a quadrature matching network to a transceiver circuit representing a load or a source. The matching network includes first, second and third transmission lines which are arranged in a "Z" configuration. The first transmission line matches impedances between the first and second antenna elements and communicatively couples the second antenna element with a quarter wavelength phase shift of its signals to the first antenna element. The second transmission line matches impedances between the third and fourth antenna elements and communicatively couples the fourth antenna element with a quarter wavelength phase shift of its signals to the third antenna element. The third transmission line matches the resultant impedance of the coupled third and fourth antenna elements to the resultant impedance of the coupled first and second antenna elements and couples the third and fourth antenna elements to the coupled first and second antenna elements with a half wavelength phase shift of the respectively coupled signals. A fourth transmission line matches the resultant impedance of and couples the coupled first, second, third and fourth antenna elements to the load.

3 Claims, 4 Drawing Sheets

FIG. 1
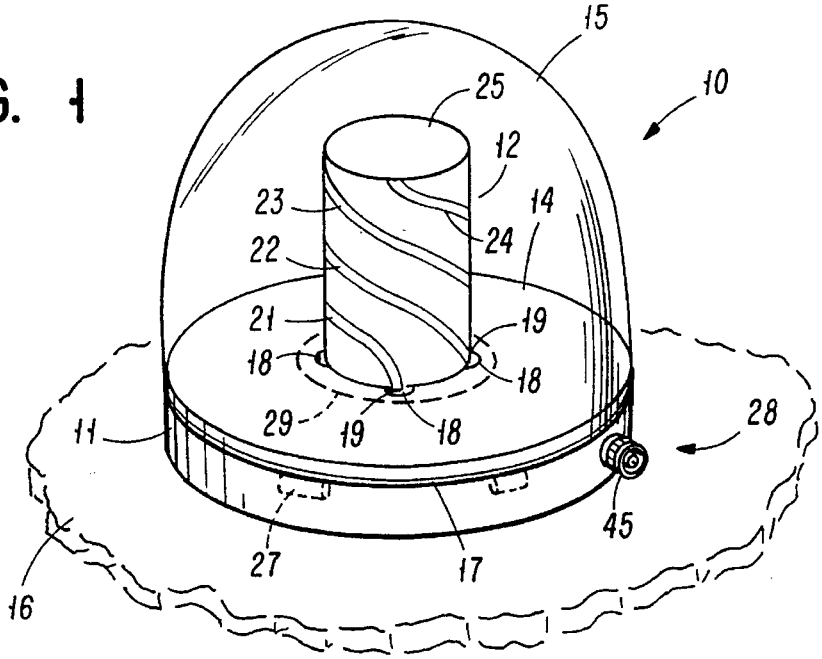
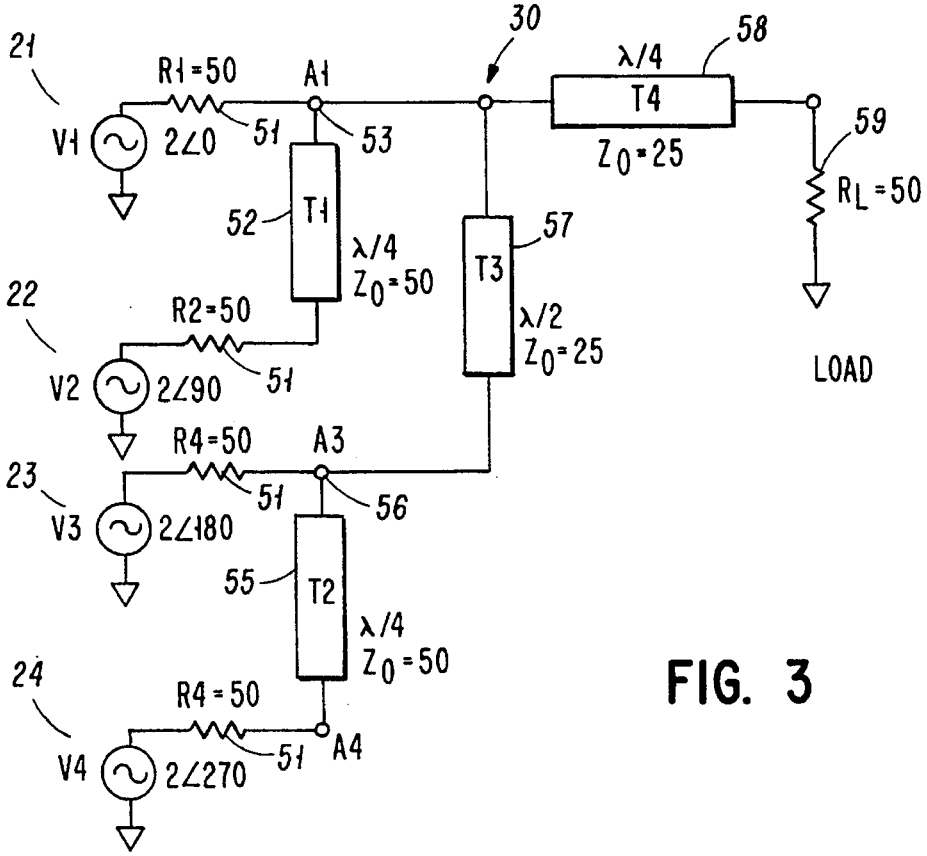
FIG. 3

LOW LOSS QUADRATURE MATCHING NETWORK FOR QUADRIFILAR HELIX ANTENNA

This application is a Continuation of application Ser. No. 08/126,836 filed Sep. 24, 1993, now abandoned.

BACKGROUND OF THE INVENTION

The invention relates generally to microwave antennas matching networks, and more particularly to microstripline matching networks for coupling the four elements of a quadrifilar microwave antenna to respective networks within receiver, transmitter or transceiver units.

Divider-combiner networks are known which couple multiple antenna elements as multiple power elements with correspondingly circularly equal phase delays to a single load. The invention addresses particular problems of coupling a single load to four circularly polarized antenna elements which are arranged in 90 degree phase relationship. Divider-combiner networks are known to work bilaterally, in transmit and in receive modes. Hence, the present invention is disclosed as an embodiment of a signal coupler which is coupled to quadrifilar antenna elements which receive in a 90 degree phase relationship to each other and the signals of which are combined prior to be coupled into a single preselector network. It should be understood, however, that advantages disclosed herein are also applicable a reversal of the antenna function according to which a transmitter applies signals through the divider-combiner network to respective quadrifilar antenna elements to radiate the signals to a desired receiver installation.

It will become apparent that the disclosed invention relates particularly to a satellite relay mobile communications system in which a great number of mobile earth stations are expected to communicate via a single satellite relay station to an earth base station. Antennas and corresponding antenna coupling circuits of the mobile earth stations are consequently under constraint to be efficient from both functional and cost standpoints. Functional considerations which seek to minimize size and shape of mobile earth antennas are also inherently related to system cost reduction. The size of antenna assemblies for mobile transceiver units is considered a source of possible problems because of limited mounting space for such antenna assemblies on mobile equipment, such as trucks or automobiles. The operation of the mobile transceiver units presupposes an exposure of the respective antenna assemblies to the position of the satellite relay, desirably omnidirectional quality, and further, from a practical standpoint, a practical shape and size realization to permit an antenna assembly to be mounted on the roof of a truck cab, or a similar sky-accessible location of a vehicle. A compact size of a desirable antenna assembly would further reduce a wind resistance profile at the top of a moving vehicle.

SUMMARY OF THE INVENTION

It is therefore an object of the invention to provide a quadrature matching network for a quadrifilar helix antenna, which network is compact and is conveniently located adjacent an antenna element.

It is yet another object of the invention to provide an antenna assembly including a quadrature matching network located conveniently as an interface adjacent an antenna and adjacent antenna assembly receive and transmit signal amplification networks.

It is a more particular object of the invention to provide a quadrature matching network, the network elements of which may be disposed advantageously adjacent an abutting end of quadrifilar antenna elements which are helically wound at 90° about a cylindrical dielectric support extending from a mounting plane, the mounting plane supporting channel preselector circuitry.

Thus, the invention is embodied in a quadrature matching network of transmission line transformer elements which couples a quadrifilar helix antenna to transmit or receive signal shaping circuits of a radio. The term radio, as used herein, pertains generally to either a receiver or a transmitter, or to a transceiver. The quadrifilar helix antenna has first, second, third and fourth antenna elements disposed in a 90° phase relationship with respect to a nominal wavelength of an RF signal in the microwave range. The network, according to the invention comprises first and second transmission line transformer elements coupling the second antenna element to the first antenna element and the fourth antenna element to the third antenna element, respectively. The first and second transmission line transformer elements have respective impedances which are matched to the antenna impedance of their respective antenna element. The first and second transmission line transformer elements each have a length of a quarterwave of the receive signal. A third transmission line transformer element couples the third and fourth antenna elements to the first and second antenna elements. The third transmission line transformer element has a length of a halfwave of the receive signal, and has an impedance which is matched to a combined effective impedance of the third and fourth antenna elements. The combined and phase corrected signal is coupled through an output quarterwave transmission line transformer to a signal terminal of a microwave transceiver.

According to a particular aspect of the invention, a quadrifilar radiating element of an antenna is disposed centrally on a first side of a circular dielectric substrate. The circular dielectric substrate has a ground plane on the first side thereof, and has a second side which is shielded from the radiating element of the antenna by the ground plane. The second side of the dielectric substrate carries signal amplification and preselection networks. The signal amplification and preselection networks are disposed peripherally about an area corresponding substantially to a vertical projection of the radiating element of the antenna onto the circular dielectric substrate. A quadrature matching microstrip network is disposed centrally of the signal amplification and preselection networks in an area coinciding with and centered on the area of vertical projection of the radiating element of the antenna.

According to a particular aspect of the invention, in a quadrifilar antenna assembly, a quadrature matching network coupled to a quadrifilar antenna element having first, second, third and fourth antenna elements terminating in a circular projection area centered on a circular dielectric substrate of the antenna assembly comprises a Z-type impedance matching network or Z-type microstrip transmission line transformer link assembly. The Z-type microstrip transmission line transformer link assembly has first, second and third microstrip transmission line transformer elements or strips arranged in an interconnected Z-type pattern substantially within the circular projection area. The first transmission line strip interconnects the first and second antenna elements. The second transmission line strip interconnects the first and third antenna elements, and the third transmission line strip interconnects the third and fourth antenna elements. A fourth transmission line strip is coupled to a junction between the first and second transmission line strips and an antenna output terminal and has an impedance which matches the source impedance of the antenna elements to the load impedance coupled to the antenna output terminal.

Various other features and advantages will become apparent from the Detailed Description which follows herein after.

BRIEF DESCRIPTION OF THE DRAWINGS

The Detailed Description including the description of a preferred structure as embodying features of the invention will be best understood when read in reference to the accompanying figures of drawing wherein:

FIG. 1 is schematically simplified pictorial representation of a quadrifilar microwave transmit and receive antenna assembly which represents a preferred embodiment of the present invention;

FIG. 3 is a schematic diagram of a quadrature matching microstrip circuit showing the microstrip circuit being coupled to a quadrifilar antenna having 50 ohm elements as a preferred embodiment of the present invention;

DETAILED DESCRIPTION OF THE INVENTION

Figure 2:
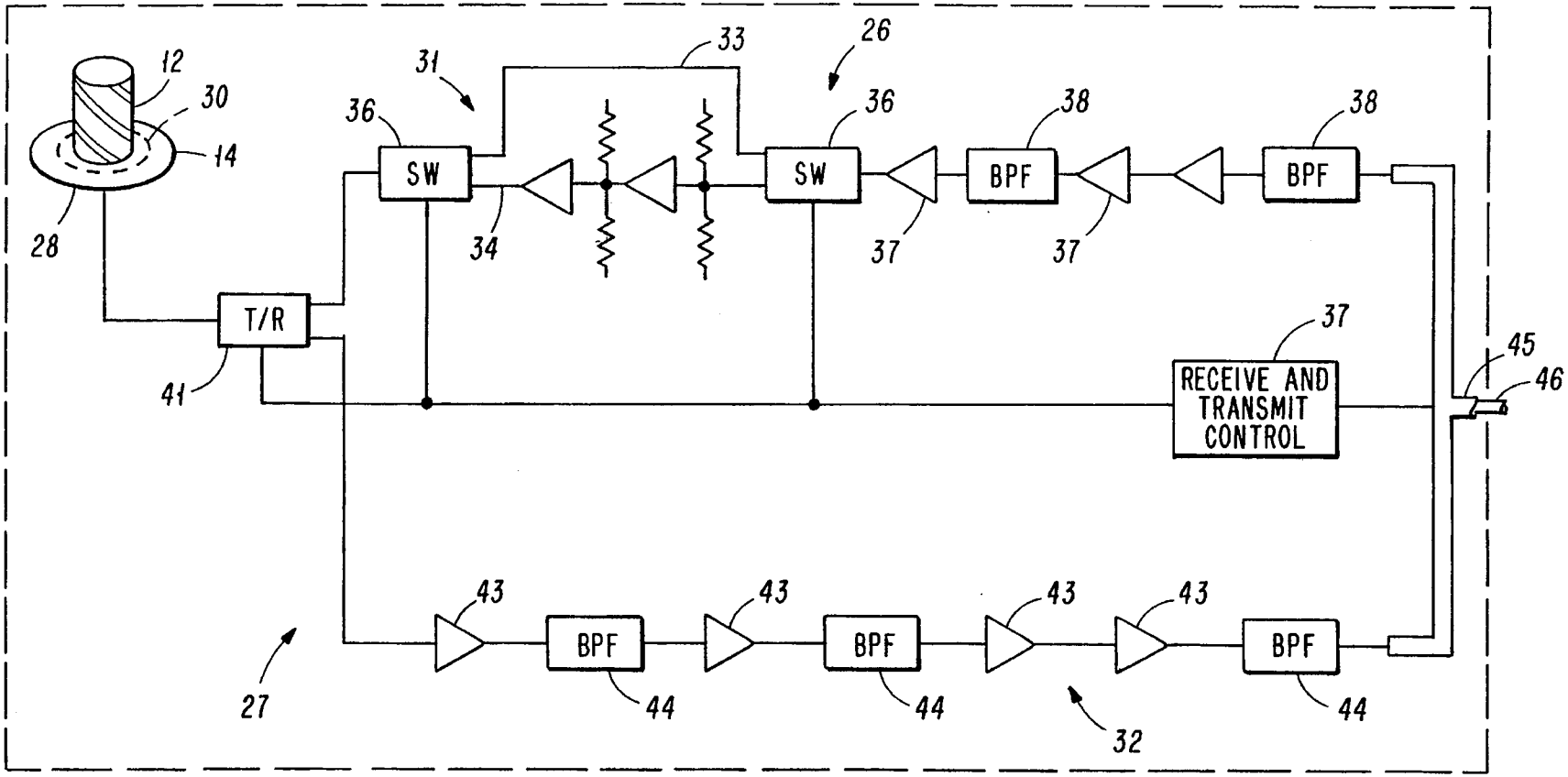
FIG. 2 is a schematically simplified diagram of a representative antenna amplifier and preselector assembly, as may preferably be mounted on a dielectric substrate of the antenna assembly as shown in FIG. 1.

In reference to FIG. 1, there is shown a quadrifilar microwave antenna assembly which is designated generally by the numeral 10. The antenna assembly 10 extends from a circular pan-like sturdy mounting base 11, preferably an aluminum casting, which also serves as a bottom housing or cover and RF shield. A quadrifilar helical antenna 12 extends centrally above a circular, rigid RF shield 14, preferably a ¼-inch thick aluminum disc 14. The shield 14 also serves as a convenient heat sink and dissipator for RF power transistors while the antenna 12 is operating in a transmit mode. The shield 14 may be mounted to, and rigidly supported by, the bottom cover 11. A parabolic or hemispherical cover 15 of preferably a microwave transparent material, such as plastic or fiberglass material, encases and protects the antenna 12. The bottom cover 11 may be mounted to a cab of a truck, train or other transportation instrumentality 16, the numeral 16 designating a portion of a roof line of a vehicle 16, in accordance with a preferred use of the antenna assembly 10 as part of a mobile, earth orbiting satellite communications system.

Further in reference to FIG. 1, a dielectric substrate 17 is preferably firmly mounted or adhesively attached to the shield 14 opposite the side from which the quadrifilar antenna 12 extends. The shield 14 has insulated apertures 18 which respective axially disposed lead through terminations 19 of four quadrifilar antenna elements 21, 22, 23 and 24. The terminations 19 are electrically short coaxial extensions of the respective antenna elements 21, 22, 23 and 24 to preserve the characteristic 50 ohm (Ω) antenna impedance. In a preferred implementation of the antenna 12, the apertures 18 are arranged in a square pattern in the shield 14. From the terminations 19, the antenna elements 21, 22, 23 and 24 wind spirally about a cylindrical dielectric core 25.

Figure 5:
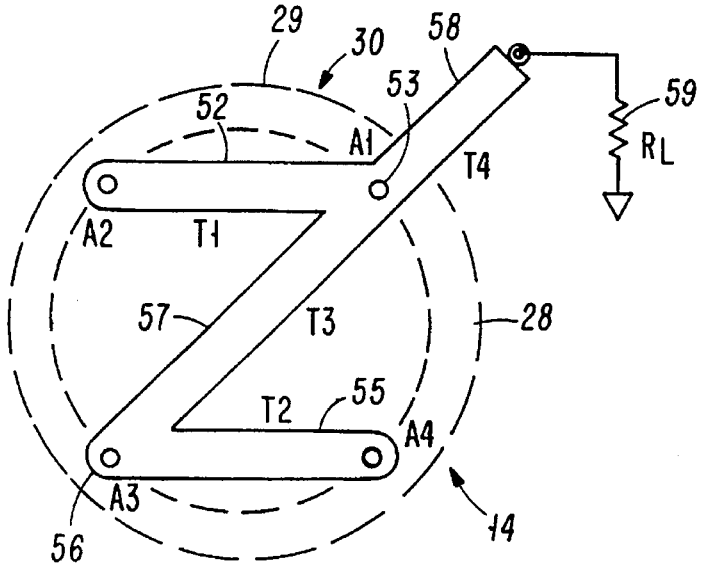
FIG. 5 is a planar representation of a Z-type microstrip transmission line transformer link layout in accordance with a preferred embodiment of the invention.

FIG. 2 shows as a schematic block diagram a transmit RF power amplifier and receive preselector assembly 26, further referred to as amplifier and preselector assembly 26. Electrical components of the amplifier and preselector assembly 26 are the components of which, designated collectively by the numeral 27, are preferably mounted to an underside 28 of the combination of the circular dielectric substrate 17 and the shield 14, thus, opposite from the quadrifilar antenna 25 itself, which is shielded from the components 27 by the ground shield 14, as shown in FIG. 1. Ideally, the components 27 are arranged in an annular pattern about a central core region 29 of the dielectric substrate 17. The core region 29 of the dielectric substrate 17 is advantageously used in accordance herewith to carry a preferred quadrature matching network 30, a preferred physical layout of which is shown in FIG. 5. The quadrature matching circuit or network 30 functions as an interface circuit 30 between the antenna 12 and the circuit components 27 of the amplifier and preselector assembly 26.

Again in reference to FIGS. 1 and 2, the components 27 of the amplifier and preselector assembly 26 shown in FIG. 2 are final signal shaping and amplification circuits of a transmit signal path 31, and signal frequency preselection and signal shaping and preamplification circuits of a receive signal path 32. The transmit signal path 31 may include a low power switch-around path 33 about a final high power amplification stage 34. A switching function may be performed by one or more switching circuits 36, such as known PIN diode switches, the switching action of which may be controlled by a receive and transmit control circuit 37. The transmit signal amplification path 31 otherwise includes a series of signal amplification blocks 37 and typical bandpass filter elements 38 for raising the signal strength of the transmit signal passed to the antenna 12.

The receive and transmit control function 37 further controls a switching operation of a transmit and receive switch 41 (T/R) which switches the operation of the amplifier and preselector assembly 26 to operate alternately in a receive mode or in a transmit mode. It should be understood, however, that the features of the invention described herein with respect to the quadrature signal matching network 30 is not intended to be limited to a transceiver application, in that both microwave signal receivers as well as microwave signal transmitters may benefit from the advantages of the features described herein. Reference is made to switchable transmit and receive paths 31 and 32 because of an contemplated use of the invention in a mobile earth station of a mobile satellite relay communication system. The referred to receive signal path includes typical amplifier blocks 43 and bandpass filters 44 of the preselection and signal amplification circuitry 32. A coaxial cable connector 45 provides for the receive or transmit signals to be transferred via a coaxial conductor between a transceiver and the amplifier and preselector assembly 26. The components 27 of the assembly 26, in being advantageously disposed on the underside 28 of the substrate 17, as schematically indicated by arrow 47, are therefore accessibly located to be directly coupled via the quadrature matching network 30 to the quadrifilar element antenna 12.

FIG. 3 shows a schematic representation of the quadrature matching network 30, as an implementation with respect to 50 ohm impedance antenna elements 21, 22, 23 and 24 of a preferred embodiment, where the respective impedance is a real number, as opposed to a complex impedance. The antenna elements 21–24 are shown schematically as voltage sources of first, second, third and fourth alternating voltage signal sources (V1, V2, V3, V4) at 90 degree phase shift with respect to an adjacent one of the sources, and with corresponding 50 ohm resistors 51. A first transmission line element 52 (T1) has a characteristic impedance of 50 ohms, matching the impedances of the first and second source elements 21 and 22. The first transmission line element 52 transforms the signal phase of the second signal (V2) from the second antenna element 22 by a quarter wavelength (λ/4) to bring it into phase with the first signal (V1) at a node 53. Similarly, a second transmission line element 55 (T2) transforms a signal phase of the fourth signal (V4) from the fourth antenna element 24 by a quarter wavelength (λ/4) to align the phase with that of the third signal (V3) at a node 56. A third transmission line 57 (T3) of a characteristic impedance of 25 ohms also functions as a signal phase transformer and delays the signal at the node 56 by one-half wavelength (λ/2) when the signal becomes coupled through the transmission line transformer element 57 (T3) to the signal node 53. A fourth transmission line element 58 preferably has a length of a quarter wavelength (λ/4) and has a characteristic impedance which matches the combined signal source impedance to the impedance of a characteristic impedance of a radio 59 ($R_L$) which is given in the illustrated example as a 50 ohm impedance. It should be understood that the characteristic radio impedance 59 may be either a load impedance, when the radio is in a receive mode, or it may be a source impedance when the radio is in a transmit mode. For sake of clarity, the invention is explained herein with the radio being in a receive mode. Using the known relationship of $$Z_0^2=Z_S*Z_L,$$

where $Z_0$ is the characteristic impedance of the matching impedance element to be determined, $Z_S$ is the source impedance, and $Z_L$ is the load impedance, then the characteristic impedance of the fourth transmission line element 58 amounts to 25 ohms.

Figure 4:
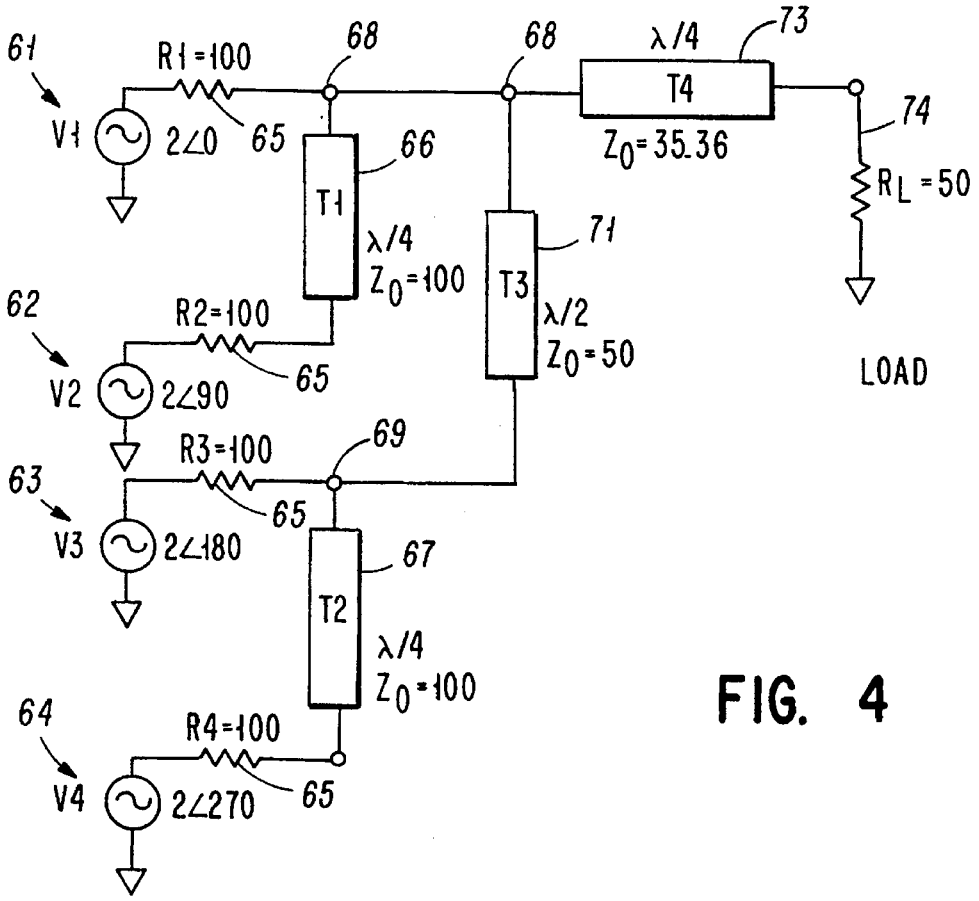
FIG. 4 is a schematic diagram of a quadrature matching microstrip circuit showing an alternate embodiment according to which a quadrature matching microstrip circuit similar to that shown in FIG. 3 is matched to a quadrifilar antenna having 100 ohm quadrifilar antenna elements.

FIG. 4 shows quadrature matching network 60 as an alternate embodiment of the described quadrature matching network 30, wherein respective first, second, third and fourth antenna elements 61, 62, 63 and 64 are shown as voltage source elements (V1 through V4) with a characteristic impedance of 100 ohms shown as respective resistors 65, indicating a real, as opposed a complex impedance. Though transmission line elements in the matching network 60 are the same in number and in function as those of the matching network 30, the characteristic impedance values are now matched to the 100 ohm impedances of the antenna elements 61 through 64. Thus, first and second phase transforming elements 66 and 67, respectively, each have a characteristic impedance of 100 ohms, transforming the phase of a second source signal V2 applied to a node 68 to be in phase with a first source signal V1. Similarly the phase of a fourth source signal V4 is transformed by the transmission line transformer element 67 to bring it into phase with a third source signal V3 as the latter signals are combined at a node 69. A third transmission line 71 further transforms the phase of the combined signals V3 and V4 to be in phase with the combined signals V1 and V2 when the combined signals V3 and V4 are applied to the functional node 68. A fourth transmission line 73 has a length of a quarter wavelength and is configured to have a characteristic impedance of 35.36 ohms to match the effective source impedance of 25 ohms of the combined antenna elements at the node 68 to the exemplary impedance of 50 ohms of a load 74.

Referring now to FIG. 5, there is shown a representative physical embodiment of the impedance matching network 30, the impedance matching network 60 being suitable of being formed into a configuration similar to that of the depicted network 30. The described impedance matching network 30 may advantageously be formed into a shape showing what is herein referred to as a Z-type impedance matching network 30. The first transmission line phase transformer element 52 couples and extends between first and second antenna elements A1 and A2, forming a first "horizontal" bar of the "Z" shape. The second transmission line phase transformer element 55 couples and extends correspondingly the third and fourth antenna elements A3 and A4, forming a second "horizontal" bar of the "Z" shape of the network 30. The third transmission line phase transformer element 57 has the length of a half wavelength and is configured to extend diametrically across the footprint of the antenna 12 between the third and first antenna elements A3 and A1, thereby completing a diagonal or slanted bar of a characteristic "Z"-shape of the impedance matching network 30 or more generally of an impedance matching network in accordance with the invention. The "Z" configuration of the impedance matching network as described herein may of course also be represented by a mirror image of a "Z" without detracting from the advantages of the invention. The output matching transmission line element 58 extends from the node 53 at the physical juncture of the first and third transmission line elements 52 and 57 substantially radially outward away from the footprint of the antenna 12 on the dielectric substrate 17. Advantageously, the described "Z-type" configuration of the impedance matching network 30 between the four antenna elements 21, 22, 23 and 24 of the quadrifilar element antenna 12 generally matches a vertical projection or footprint of the antenna 12. The described Z configuration of the impedance matching network 30 allows the physical implementation thereof to become placed on the dielectric substrate 17 substantially beneath the footprint of the antenna 12 on the underside of the dielectric substrate 17. The transmission line element 58 is placed on the dielectric substrate 17 to lead out of the core region 29 of the substrate 17 and become coupled to the corresponding components 27 of the amplifier and preselector assembly 26 (see FIG. 2), represented in FIG. 5 generally by a source impedance 59 or load 59 (in a receive mode of a coupled radio).

Figure 6:
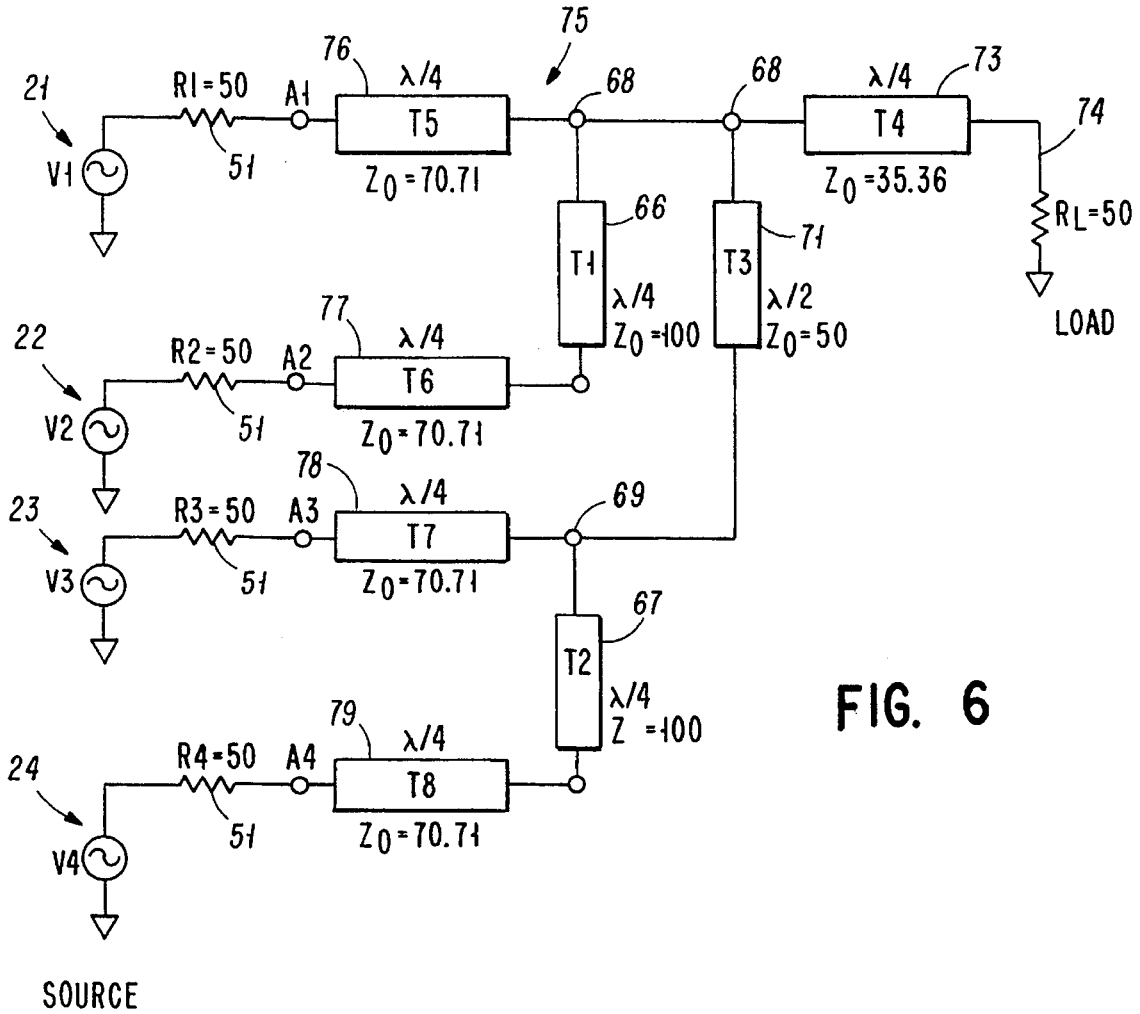
FIG. 6 is schematic diagram of an alternate embodiment of the quadrature matching microstrip circuit shown in FIG. 4, showing additional input impedances coupled to each of the antenna elements of the quadrifilar antenna.

FIG. 6 is a schematic diagram of an alternative embodiment of the impedance matching network 30 for a 50 ohm impedance antenna 12 as shown in FIG. 3. In general, an impedance matching network 75 interposes at each of the respective antenna elements (A1, A2, A3, A4) first, second, third and fourth transmission line elements 76, 77, 78 and 79, respectively, to increase the characteristic impedance of each of the antenna elements A1, A2, A3 and A4, as seen from a load side of the matching network 75, to 100 ohms.

Using the relationship $Z^2=Z_S*Z_L$ a characteristic impedance for each of the transmission line elements 76, 77, 78 and 79 is determined to be $Z_0$=70.71 ohms to raise the impedance on the matching network side of the transmission line elements 76, 77, 78 and 79 to 100 ohms. Further elements of the impedance matching network 75 are identical to the impedance matching network 60 described in reference to FIG. 4. These elements may be arranged advantageously in a characteristic Z-type configuration, as described in reference to FIG. 5. The additional transmission line elements 76, 77, 78 and 79 may be arranged conveniently in a peripheral area of the core region 29 about the Z-type matching network portion of the network 75 (see FIG. 7).

Figure 7:
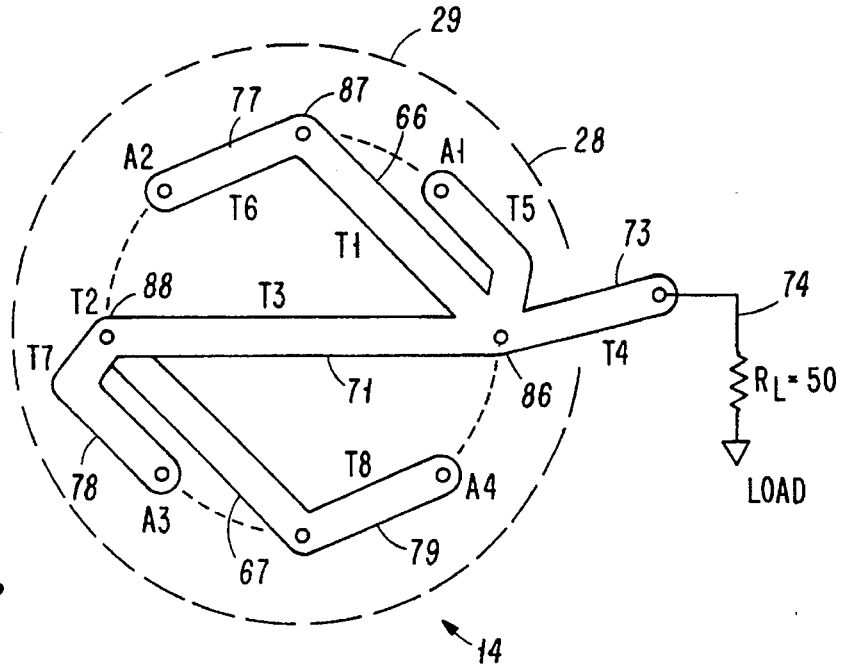
FIG. 7 is one of a number of possible planar representations or physical layouts of the circuit shown in the schematic diagram of FIG. 6.

In reference to FIG. 7, the transmission line elements 66, 67 and 71 are arranged in the described Z-type pattern, with the load matching transmission line element 73 leading out of the core region 29 and being coupled to the effective load 74 representing a radio circuit. A transmission node 86 which corresponded to a first antenna A1 termination of the matching network 30 in FIG. 5, is now coupled to the first antenna element A1 via the transmission line element 76. Correspondingly, a node 87 is coupled via the transmission line element 77 to the antenna element A2, a node 88 is coupled via the transmission line element 78 to the antenna element A3, and a node 89 is coupled via the transmission line element 79 to the fourth antenna element A4. The transmission line elements may, in accordance with known design practices, extend straight or follow a meandering path. However, it should be noted that each of the transmission line elements 76 through 79 must have, in accordance herewith, the same transmission line characteristics. Thus, each of the transmission lines 76 through 79, in accordance with the specific example described herein, shift the applied signal by one quarter of a wavelength and have the same characteristic impedance of 70.71 ohms. As long as the above phase shift and impedance matching conditions are observed, the arrangement of the matching network described with respect to FIGS. 6 and 7 is applicable, more generally, to match virtually any antenna element driving point impedance, of either real or complex value. The matching occurs in such general cases in the characteristic impedance and in the length of the respective transmission line elements 76 through 79 to conjugately match the network to the driving point impedance, while the described Z-type network configuration is advantageously retained.

The described Z-type impedance matching network has been determined to result in relatively low losses over a typical bandwidth spectrum as may have been assigned to mobile communications systems which use mobile transceiver stations communicating over satellite relay stations with stationary base stations. In such systems, a compactness of the described Z-type matching network 30 or an alternate embodiment thereof which allows the network 30 to be mounted in proximity to the elements of a quadrifilar antenna and the amplifier and preselector assembly 26 tends to minimize signal losses as well as provide a practical size for a vehicle mounted microwave antenna assembly 10.

Though the shield 14 and the dielectric substrate 17 have been described herein as being circular in configuration, it should be realized that the circular shapes were chosen in support of a non-directional symmetry with respect to the center-mounted antenna 12. The circular footprint particularly facilitates mounting the parabolic or hemispherical cover 15 to the antenna assembly 10. However, the disclosed features of invention pertaining to the matching network 30 or its equivalent alternate embodiments are not dependent on circular configuration and are applicable to antenna assemblies of various other shapes as well.

It is, therefore, generally to be noted that the embodiments herein are described for illustrative purposes and are merely specific examples of apparatus or methods pursuant to the invention. Various changes and modifications to the described embodiments may be made in view of the teachings in the above description without departing from the spirit and scope of the invention as defined by the claims below.

What is claimed is:

1. A quadrature matching network in a quadrifilar antenna assembly of a quadrifilar helical antenna of first, second, third and fourth antenna elements of a radio, each antenna element having a proximal end and a distal end being a free end, each antenna element being coupled, at its proximal end only, to the quadrature matching network each antenna element having an impedance, and each antenna element communicating signals in a 90 degree phase relationship with respect to any adjacent one of the antenna elements, the quadrature matching network comprising:

a first transmission line element of a characteristic impedance matching the impedance of the second antenna element to the impedance of the first antenna element, the first transmission line element coupling the second antenna element to the first antenna element and transforming the phase of the communicated signal of the second antenna element to the phase of the communicated signal of the first antenna element;

a second transmission line element of a characteristic impedance matching the impedance of the fourth antenna element to the impedance of the third antenna element, the second transmission line element coupling the fourth antenna element to the third antenna element and transforming the phase of the communicated signal of the fourth antenna element to the phase of the communicated signal of the third antenna element;

a third transmission line element having a characteristic impedance matching the impedance of the coupled third and fourth antenna elements to the impedance of the coupled first and second antenna elements, the third transmission line element coupling the third and fourth antenna elements to the first and second antenna elements and transforming the phase of the communicated signal of the coupled third and fourth antenna elements to the phase of the communicated signal of the coupled first and second antenna elements; and a fourth transmission line element having a characteristic impedance matching the impedance of the coupled first, second, third and fourth antenna elements to the impedance of the radio wherein said first, second, third and fourth transmission line elements are combined on a single circuit board spaced at the proximal ends of said first, second, third and fourth antenna elements.

2. The quadrature matching network according to claim 1, wherein the radio is in a transmit mode and the impedance of the radio constitutes a source impedance.

3. The quadrature matching network according to claim 1, wherein the radio is in a receive mode and the impedance of the radio constitutes a load impedance.

* * * * *